United States Patent [19]

Hanazono et al.

[11] 4,283,150

[45] Aug. 11, 1981

[54] TYPEWRITER

[75] Inventors: Masami Hanazono; Tomoyoshi Watanabe; Toshio Nakai; Susumu Kuzuya; Akira Asai; Takayuki Iwase; Kazuo Nakamura; Hiroshi Onoda, all of Nagoya, Japan

[73] Assignee: Brother Kogyo Kaisha, Aichi, Japan

[21] Appl. No.: 38,845

[22] Filed: May 14, 1979

[30] Foreign Application Priority Data

May 27, 1978 [JP] Japan ..... 53-63662

[51] Int. Cl.[3] ..... B41J 5/22; B41J 23/02

[52] U.S. Cl. ..... 400/666; 400/52

[58] Field of Search ..... 400/50-52, 400/425, 478, 161.1, 664-666

[56] References Cited

U.S. PATENT DOCUMENTS

| | | | |
|---|---|---|---|
| 3,045,799 | 7/1962 | Seymour et al. | 400/666 |
| 3,135,371 | 6/1964 | Young | 400/666 |
| 3,191,740 | 6/1975 | Smusz et al. | 400/666 |
| 3,349,884 | 10/1967 | Francisco | 400/425 |
| 3,353,646 | 11/1967 | Young | 400/665 |
| 3,554,348 | 1/1971 | Herrmann | 400/666 |
| 3,568,811 | 3/1971 | Johnson | 400/666 |
| 3,642,110 | 2/1972 | Hishida et al. | 400/666 |
| 3,718,243 | 2/1973 | Chvatlinsky | 400/425 |
| 3,721,327 | 3/1973 | Werf et al. | 400/666 |
| 3,871,505 | 3/1975 | Theilen | 400/161.1 |

*Primary Examiner*—William Pieprz

*Attorney, Agent, or Firm*—Browdy and Neimark

[57] ABSTRACT

An electric typewriter having a prevention mechanism for preventing printing errors caused by a depression of a few keys in very rapid succession. The prevention mechanism includes a lock member for locking a clutch, which is interposed between a drive motor and a printing mechanism, in a disengaged condition. The lock member is normally held in a non-operational position for allowing the clutch to be engaged, and is moved in response to a special operation of a sensing member to an operational position for keeping the clutch in a disengaged condition. The sensing member is so disposed as to be moved in a distinct way different from the normal operation mode when a few keys have been depressed in very rapid succession.

5 Claims, 5 Drawing Figures

TYPEWRITER

BACKGROUND OF THE INVENTION

This invention relates to a typewriter capable of preventing printing errors which is often caused by a depression of a few keys in very rapid succession.

In most of the conventional typewriters, including with a single type print-head, printing error such as printing of an undesired character, omitting of a desired character, etc. is apt to occur when two keys are depressed at a time or when a key is depressed prior to the completion of a printing cycle of a previously depressed key. It is therefore desirable to develop a typewriter capable of preventing such printing errors or capable of giving the typist a chance to retype the correct character.

It has been regarded as a very difficult job to develop a printing error preventing typewriter of mechanical type, especially those with a single print-head. Making of a typewriter of mechanical type with a single print-head capable of alerting the typist of the trouble for enabling the typist to rectify the printing error has been desired for a long time. All of the devices hitherto developed have been unsatisfactory in respect of the function and/or manufacturing cost.

SUMMARY OF THE INVENTION

It is therefore an object of this invention to provide a typewriter which is not only novel in its structure or mechanism capable of alerting the typist of happening of a printing error, but also satisfactory in its function and manufacturing cost.

DETAILED DESCRIPTION OF A PREFERRED EMBODIMENT

Figure 1:
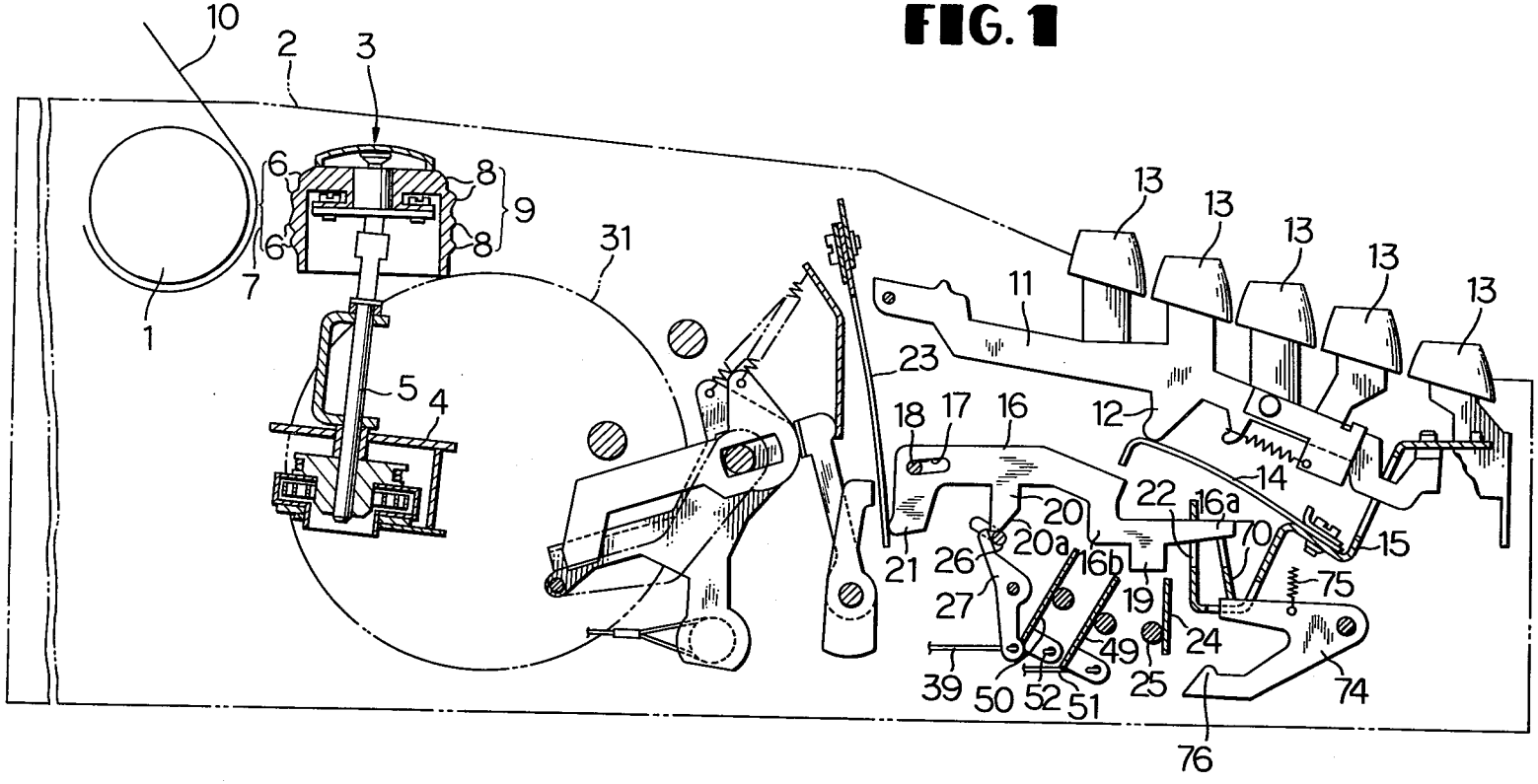
FIG. 1 is a longitudinal, vertical cross section of an essential structural part of an embodiment of a typewriter in accordance with this invention.

A platen 1 is attached to a laterally movable carriage (not shown) of a typewriter in the rear (left in FIG. 1) portion of a machine frame 2. A print-head 3 is supported, in front of the platen 1, by a support base 4 with a print-head supporting shaft 5. On one half of the outer surface of the print-head 3, eleven letter-rows 7 each containing four lower case letter types 6, formed in relief, are vertically arranged with an equal interval to each other; on the other half of the outer surface thereof, eleven letter-rows 9 each containing four upper case letter types 8, formed in relief, are vertically arranged, in a similar way, with an equal interval to each other. Among the eleven letter-rows 7 of the lower case letter types 6 the central one is normally confronted to the platen 1. When a key corresponding to one of the lower case letter types 6 is selectively depressed, based on a later described selecting operation of the key, the lower case letter types 6 corresponding to the key is selected on the print-head 3 by means of, via a character selecting mechanism (not shown), a proper tilt movement and rotational movement of the print-head 3, for being brought to a printing operation on a typing paper 10 placed on the platen 1. When an upper case letter type 8 is desired the above-mentioned key depression, posterior to an operation of a shift key (not shown), is enough for the purpose of selecting the desired upper case letter 8 corresponding to the key. Character selecting mechanism, including the tilt selecting and the rotational selecting, and shifting mechanism are omitted here, these features being conventional and well known.

An operational mechanism, including a clutch for imparting input information to a character selecting mechanism, is described hereunder.

Key levers 11, plural in number, one being visible in FIG. 1, are disposed in the front portion of the machine frame 2 with a projection 12 formed downwardly on each of the key levers 11; a respective key 13 for typing operation is mounted on each key lever 11.

An operation plate 14, as shown in FIG. 1, made of a resilient material is disposed under the visible key lever 11, being secured at the front end thereof to a frontal machine frame 15, being confronted with the respective projection 12 in the vicinity of the front end thereof, and being bent downwardly at the rear end portion thereof almost perpendicularly. The operation plate 14 is to be, when the key lever 11 is depressed, downwardly urged at the rear end portion thereof by the projection 12 operating against the resilience of the plate.

An interposer 16, plural in number, is disposed under the operation plate 14 respectively corresponding thereto, and has an elongated through bore 17 extending longitudinally rather upperly positioned in the vicinity of the rear end thereof. The interposer 16 is carried, via the elongated through bore 17, by a mounting shaft 18, which is laterally spanned between both lateral end walls of the machine frame 2, in a longitudinally and rotationally movable manner. A downward movement of the operation plate 14 rotates the front end portion of the interposer 16 downwardly about the axis of the mounting shaft 18. The interposer 16 is provided with, in the front end portion thereof, a projection 19 formed downwardly, in the middle portion thereof, a projection 20 formed downwardly with a cam surface **20*a* formed on the lower end thereof, and in the rear end portion thereof a projection 21 formed downwardly and also slightly rearwardly. A regulating hole 22 is formed through the frontal machine frame 15, in which the front end portion 16*a* of the interposer 16** is to be inserted in a longitudinally and vertically movable manner so as to limit the motion only in one plane.

An interposer-returning spring 23, plural in number, is secured at the upper end thereof to the machine frame 2, and is abutted at the lower end thereof to the projection 21 of each interposer 16 respectively for biasing the same in the counterclockwise direction in FIG. 1 about the axis of the mounting shaft 18. It holds the interposer 16 at its upper limit position, while the interposer 16 is in a stationary non-operational state, by means of engaging the front end portion of the interposer 16 with the upper end of the regulating hole 22.

A drive plate 24 is secured, under the front end portion **16*a* of the interposer 16, to a support shaft 25, which is rotatably carried at lateral ends thereof by the machine frame 2, and is normally retained at an upright position as an initial position. The drive plate 24 is so disposed as to be, after having been rotated rearwards over a certain angle, rotatingly restored to the upright position; when the interposer 16 has been moved by the movement of the operation plate 14 to the lowest possible position, a first operational position thereof, due to the depressing of the key 13, the projection 19 of the interposer 16 is positioned within the rotational locus of the drive plate 24**.

Figure 2:
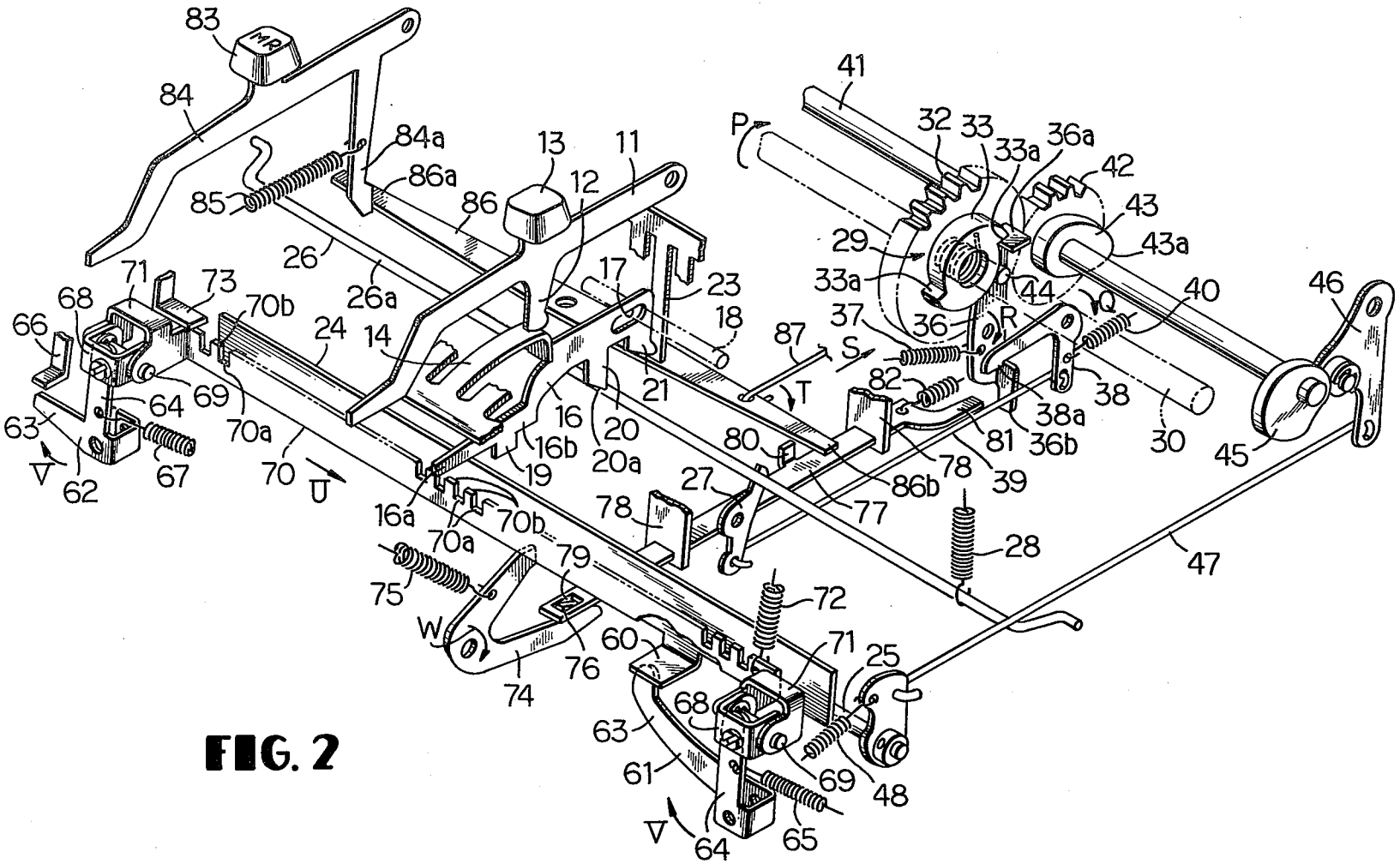
FIG. 2 is a perspective view of an essential structural part of a typewriter in accordance with this invention.

A clutch controlling rod 26 is so disposed, under the middle portion of the interposer 16, as to span, and being rotably carried by and relative to, the machine frame 2, and the both lateral ends thereof are bent as shown in FIG. 2 in a crank form for providing in the middle portion thereof an engaing portion 26*a* by forwardly projecting. The engaging portion 26*a* is in confrontation with the projection 20 of the interposer 16, so the engaging portion 26*a* is to be rotated downwards, when the interposer 16 is depressed downwardly, by the projection 20. A clutch control link 27 is at the middle portion thereof pivotally mounted such that the upper portion thereof can be abutted on a part of the engaging portion 26*a* of the clutch controlling rod 26; and when the engaging portion 26*a* is downwardly rotated the upper end of the clutch control link 27 is rearwardly rotated. A spring 28 is normally biasing the engaging portion 26*a* of the clutch controlling rod 26 in an upward direction.

Figure 3:
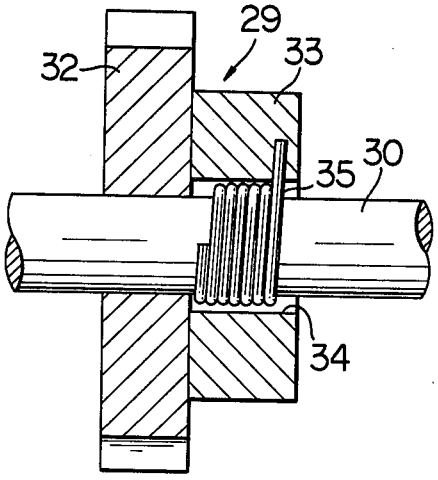
FIG. 3 is a vertical cross section of a clutch mechanism.

A clutch 29 will be explained with reference to FIG. 3. A drive shaft 30 is, via a suitable conventional non-illustrated connecting mechanism, linked to a drive motor 31, so that it may be rotated in the direction marked with the arrow P. A first gear 32 is rotatably carried by the drive shaft 30. A clutch member 33 is fixed on one side of the first gear 32, with a pair of clutch pawl portions 33*a* formed on it at a 180° mutual phase difference. The clutch member 33 is provided with a through bore 34 through which the drive shaft 30 is loosely fitted. A clutch spring 35 is fitted on the drive shaft 30 within the through bore 34, one end of which is tightly wound around the drive shaft 30 in the rotational direction thereof and the other end of which is secured to the clutch member 33.

When the clutch pawl portions 33*a* of the clutch member 33 and a later described clutch regulating lever 36 are engaged with each other, only the drive shaft 30 is rotated; and when the clutch pawl portions 33*a* and the clutch regulating lever 36 are not in engagement, the rotation of the drive shaft 30 in the direction of the arrow P is transmitted, to the clutch member 33 and the first gear 32 by the clutch spring 35.

The clutch regulating lever 36 is, in the neighborhood of the clutch member 30, pivotally supported in the middle portion thereof, and the upper end thereof is shaped into an engaging end portion 36*a* capable of releasably engaging with the clutch pawl portions 33*a*. When the engaging end portion 36*a* is engaged with any one of the clutch pawl portions 36*a*, the arrow P directional rotation of the clutch member 33 is blocked or prevented to halt the rotation of the first gear 32. And a spring 37 is normally biasing the clutch regulating lever 36 in the disengaging direction from the clutch pawl portion 33*a*. A holding lever 38 is pivotally supported in the middle portion thereof, in the neighborhood of the clutch regulating lever 36, for holding the clutch regulating lever 36 in an engageable state with the clutch pawl portion 33*a* resisting the force of the spring 37. The holding lever 38 is provided, on one end thereof, with a restricting portion 38*a* for engaging with the lower end portion of the clutch regulating lever 36, which is in engagement with the clutch pawl portion 33*a*, with the purpose of keeping the clutch regulating lever 36 at the above-mentioned state, resisting the force of the spring 37.

On the other end of the holding lever 38 is linked one end of a connecting rod 39, which is interposed between the holding lever 38 and the lower end of the clutch control link 27. So the holding lever 38 is constructed such that it may be rotated, when the clutch control link 27 is counterclockwise in FIG. 1 rotated due to a downward movement of the engaging portion 26*a* of the clutch controlling rod 26, in the direction of the arrow Q in FIG. 2 to disengage the restricting portion 38*a* of the holding lever 38 from the lower end of the clutch regulating lever 36. Due to the above movement, the engagement of the clutch regulating lever 36 and the clutch pawl portion 33*a* is to be released, because the clutch regulating lever 36 is rotated, in accordance with the force of the spring 37, in the direction marked with the arrow R in FIG. 2. A spring 40 pulls the holding lever 38 in the counter Q arrow direction, which is positive in keeping the engagement with the holding lever 38 and at the same time which is positive in biasing the clutch control link 27 to the engagement with the clutch controlling rod 26.

A cam shaft 41 is disposed rotatably and in parallel to the drive shaft 30, on which is secured a second gear 42 in mesh with the first gear 32, with the gear ratio between the former and the latter 1:2. A return cam 43 is secured, in an adjacent position to the second gear 42, on the cam shaft 41, whose outer peripheral cam surface 43*a* being in confrontation to a cam follower 44 which is free rotatably mounted on the clutch regulating lever 36. A rotation of the return cam 43 caused by the rotation of the cam shaft 41 will rotate the clutch regulating lever 36 through the cam follower 44, in the direction of coming into engagement with the clutch pawl portion 33*a* and the holding lever 38.

A driving cam 45 is secured on one end of the cam shaft 41, whose cam follower 46 is connected, to the support shaft 25 via a connecting rod 47. The cam follower 46 is pulled by a spring 48 to be urged onto a cam surface 45*a* of the driving cam 45, which cam follower 46 normally functions to retain the drive plate 24 in the upright position. And every one rotation of the driving cam 45 causes the drive plate 24 to rearwardly rotate a certain angle from its upright position and return to the upright position.

When a key lever 11 is, due to an operation of a key 13, depressed the interposer 16 corresponding to the selectively operated key 13 will be moved downwardly, via the operation plate 14, about the axis of the mounting shaft 18. The engaging portion 26*a* of the clutch controlling rod 26 is in consequence to be downwardly rotated by the projection 20 of the interposer 16 for rotating the clutch control link 27 counterclockwise in FIG. 1. The holding lever 38, which is connected to the lower end of the clutch link 27 via the connecting rod 39, is therefore rotated in the direction of disengaging the same from the clutch regulating lever 36, which further causes the engaging end portion 36*a* of the clutch regulating lever 36 to be disengaged from the clutch pawl portion 33*a* of the clutch member 33, owing to the force of the spring 37.

Figure 4:
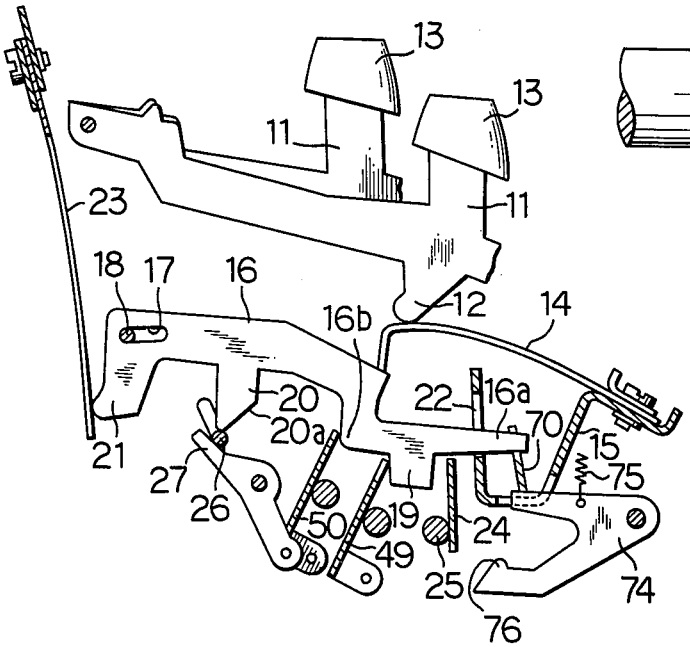
FIG. 4 is an explanatory view for explaining the status of an interposer which has been moved to a first operational position.
Figure 5:
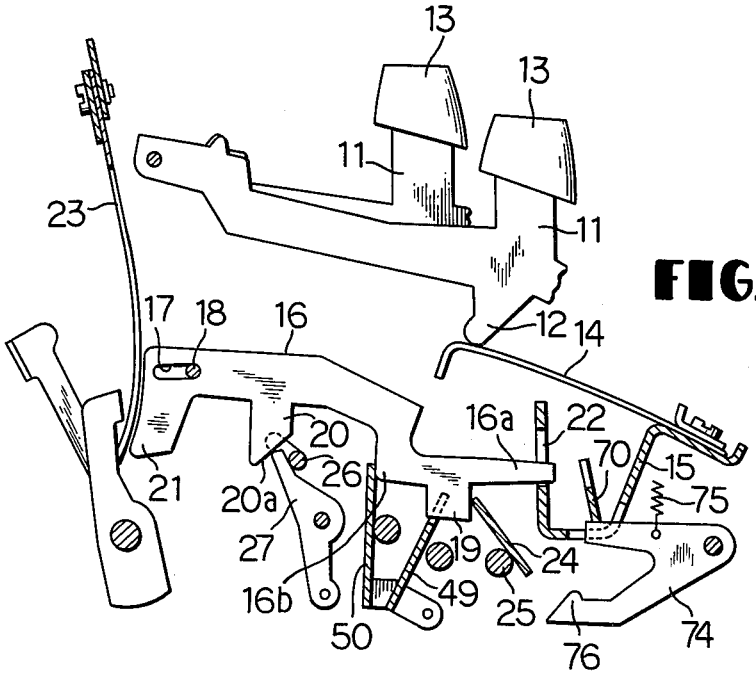
FIG. 5 is an explanatory view for explaining the status of the interposer which has been moved to a second operational position.

The clutch member 33 is therefore rotated, via the clutch spring 35, in the direction of the arrow P together with the drive shaft 30, which rotation is transferred from the first gear 32 to the second gear 42, causing the driving cam 45 to be rotated through the cam shaft 41. The rotation of the driving cam 45 will cause, via the cam follower 46 and the connecting rod 47, the drive plate 24 to be rearwardly rotated to the lowest movable position as shown in FIG. 4, for being engaged with the projection 19 of the interposer 16 which is located at its first operational position. The interposer 16 is consequently moved leftwardly in FIG. 4, which means that the interposer 16 is in this way moved to a second operational position where it bends the corresponding interposer returning spring 23, resisting the force thereof, as shown in FIG. 5. In this second operational position, the interposer 16 actuates a rotational movement selecting mechanism (not shown) for the print-head 3 (which is a part of the character selecting mechanism). Owing to the above-mentioned operation, a rotational movement corresponding to the key is imparted to the print-head 3. When the interposer 16 is moved from the first operational position to the second operational position, a pair of code bars 49, 50 for tilting are selectively driven by a step portion **16*b* and the projection 19 of the interposer 16, that is to say, in four way selecting mode: two code bars are driven in unison, either one is driven, and neither is driven. Those four ways of movement are transmitted through connecting rods 51, 52 in FIG. 1 to a tilt selecting mechanism (not shown). The print-head 3 can carry on four kind of tilt movements properly according to those selecting mode. Lower case letter types 6 corresponding to the interposer 16** are thus selected.

When the interposer 16 is rearwardly moved, the engagement between the engaging projection 20 of the interposer 16 and the clutch controlling rod 26 is released to return the latter upwards, according to the force of the spring 28, then the upward returning of the clutch controlling rod 26 is carried out promptly at the beginning of the rearward movement of the interposer 16, as the front edge of the projection 20 is provided with a cam surface **20*a***.

When the cam shaft 41 is rotated one round and the driving cam 45 is rotated one round, the drive plate 24 is thereby restored forwardly to stand upright by means of the cam follower 46, the connecting rod 47 and the spring 48. Then the interposer 16 is to follow the drive plate 24, with the driving projection 19 being in engagement with the drive plate 24 due to the force of the interposer returning spring 23. In this situation the clutch controlling rod 26 is already restored as earlier stated to the upper position and its engaging portion **26*a* is placed within the range of the restoring movement of the projection 20 of the interposer 16. However, because of the presence of that cam surface 20*a* formed on the lower end of the projection 20, the projection 20 can slantly slide forward-up, at its cam surface 20*a*, along the surface of the engaging portion 26*a* of the clutch controlling rod 26 as the interposer 16 is forwardly moved. The interposer 16 can therefore be restored to the non-operating position shown in FIG. 1 by being moved forward-up without any hindrance by the clutch controlling rod 26**. The rotational movement selecting mechanism and the tilt selecting mechanism are respectively restored to the initial position by the above-mentioned operation.

When the clutch controlling rod 26 is restored upwards, the clutch control link 27, which is in engagement with the former, is to follow the former due to the force of the spring 40, resulting in returning the retaining lever 38, which is connected to the clutch control link 27 by the connecting rod 39, to the engaged position with the clutch regulating lever 36. On the other hand, the clutch regulating lever 36 is, due to the rotation of the return cam 43 accompanied by the rotation of the cam shaft 41, returned to a position where the engaging end portion **36*a* can come into engagement with the clutch pawl portion 33*a* and the lower end portion of the clutch regulating lever 36 can be engaged with the retaining lever 38, which is already returned, for retaining the clutch regulating lever 36 at this engaged state. This will lead the clutch pawl portion 33*a* of the clutch member 33 which has been rotated half a round to an engagement with the engaging end portion 36*a* of the clutch regulating lever 36 to hold the first gear at a state of having made half a round. Accordingly the cam shaft 41 will stop upon making one round rotation, at which the entire work caused by one key operation is completed. A relative operation among the interposer 16, the clutch 29, and the print-head 3** due to one operation of the key is generally repeated in the above-mentioned mode.

Now the mechanism for preventing the printing errors due to a rapid typing operation, which is the very essence of this invention, is to be described.

On the lower edge of the drive plate 24 is formed a tongue portion 60, a flat bent portion substantially at right angle to the drive plate 24. A pair of cranks 61, 62 of L-shape are both rotatably supported by the machine frame 2 as shown in FIG. 2. They are respectively composed of a first and a second arm 63, 64; the crank 61 on the right side which is urged by a spring 65 is abutted under pressure on the lower surface of the bent-formed tongue portion 60 at the end of the first arm 63, and the crank 62 on the left side which is also urged by a spring 67, is engaged with a stopper 66 secured to the machine frame 2 at the end of the first arm 63.

A pair of U-shape members 68 are respectively carried by the end portion of the second arm 64 in a rotatable manner. Each supporting shaft 69, 69 is respectively fixed to the both U-shape members 68, 68. A sensing member 70 is formed in a comb shape, being disposed parallelly to the drive plate 24 with a predetermined distance therefrom and located under the front end portion **16*a* of the interposer 16. On either end of the sensing member 70, a supporting portion 71, 71 is respectively formed integrally therewith by bending a part thereof as shown in FIG. 2. Those supporting portions 71, 71 are rotatably carried by the supporting shaft 69 respectively such that the sensing member 70 can be in parallel to the drive plate 24. A tension spring 72 urges the sensing member 70 for making the same to abut under pressure on to the lower surface of a guide plate 73. With such a construction, the sensing member 70, while the drive plate 24 is in the upright position shown in FIG. 2, is positioned such that, owing to the pair of cranks 61, 62 which are positioned by the engagement with the tongue portion 60 bent-formed from the drive plate 24, recess portions 70*a* of the sensing member 70 are postioned just under the front end portion 16*a* of the interposer 16 and protruded portions 70*b* of the sensing member 70 are positioned just under the intervals between each of every two interposers 16. In this state of postioning, each interposer 16 can be depressed without being blocked by the sensing member 70**.

A swing member 74 is pivoted on the machine frame 2 so as to be positioned under the sensing member 70. One end of the swing member 74 is normally pulled by a tension spring 75 so as to be able to abut under pressure on to the lower surface of the sensing member 70, and the other end thereof is extended, under the sensing member 70, rearward beyond the same, and further on the extended end portion thereof is formed a hook portion 76. A locking member 77 is slidably supported by a pair of guide members 78. On one end of the locking member 77 is formed an opening 79 for being engaged with the hook portion 76, on the middle portion thereof is formed a projection portion 80 bent-formed therefrom, and the other end 81 thereof is extended as far as close to a flat portion **36*b* of the clutch regulating lever 36. A tension spring 82 is to normally retain the locking member 77 at the state wherein the opening 79 is engaged with the hook portion 76 to keep the locking member 77 at the non-operating position shown in FIG. 2 while biasing the locking member 77 in the direction wherein the other end 81 of the locking member 77 goes to abut the flat portion 36*b* of the clutch regulating lever 36**.

A margin release key 83 is fixed on a key lever 84 for margin releasing, which is normally retained in a non-operational condition by a tension spring 85. A lever 86 is biased by a connecting wire 87 so as to be, at one end **86*a* thereof, engageable with a depending portion 84*a* of the key lever 84 for margin releasing, and is so positioned, at the other end 86*b* thereof, as to have a predetermined distance from the projection portion 80 of the locking member 77, when the locking member 77 is located in a state shown in FIG. 2. And the distance between the other end 86*b* and the projection portion 80, in the state shown in FIG. 2, is made slightly larger than the distance between the end 81 of the locking member 77 and the flat portion 36*b* of the clutch regulating lever 36, so when the engagement between the opening 79 of the locking member 77 and the hook portion 76 of the swing member 74 is released, the end 81 can be moved as far as the operational position wherein the same abuts on the flat portion 36*b* of the clutch regulating lever 36 which is in engagement with the clutch pawl portion 33*a*. The locking member 77 once moved is, because of the positioning of the projection portion 80 immediate prior to the engagement with the other end 86*b* of the rotating lever 86, to be restored to the state shown in FIG. 2, due to the T directional movement in FIG. 2 of the rotating lever 86 acutated by the depression of the margin release key 83, by being moved in the reverse direction of S arrow, resisting the resilience of the tension spring 82. The margin release key 83 and the rotating lever 86** are thus related with each other as manually operable members.

Explanation on the conventional margin releasing mechanism (not shown) which is connected with the lever 86 via the connecting wire 87, is omitted here.

The printing error preventing mechanism for preventing printing errors caused by a rapid typing operation functions as follows. As the sensing member 70 is not affected at all, while the drive plate 24 is kept in the upright position, by the transition of the interposer from the non-operational position to the first operational position due to a depression of the key lever 11, so it is allowed to keep the state shown in FIG. 2. Since the clutch mechanism 29 for character printing comes to an engaged condition caused by the depression of the key lever 11, the earlier mentioned operation of the interposer 16 can be ensured.

If, within the time interval wherein the drive plate 24 completes one round travel of rotational movement (60 milisecond in this embodiment) due to the first depressing operation of the key lever 11, no other depressing operation of the key lever 11 is done, the printing error preventing mechanism is not required to work for preventing the printing errors. Type printing operation is proceeded without any hindrance under such a condition.

Explanation must be advanced to a case wherein a second depressing operation of the key lever 11 is carried out before the travel of the rotational movement of the drive plate 24 owing to the first depressing operation of the key lever 11 has not been completed. The pair of the cranks 61, 62 which are located on the right and left side of the sensing member 70, tend to rotate in the direction marked with the arrow V due to the force of the springs 65, 67 caused by the rotational movement of the drive plate 24, however, the cranks 61, 62 are not allowed to rotate in the arrow V direction because the front end portion **16*a* of the interposer 16 is still positioned in the recess 70*a* of the sensing member 70, i.e., in the first operational position, in accordance with the first depressing operation of the key lever 11. In the course of transition of the interposer 16, due to the rotational movement of the drive plate 24, from the first operational position to the second operational position, at the very moment of pulling out of the front end portion 16*a* of the interposer 16 from the recess 70*a* of the sensing member 70, the cranks 61, 62 begin to rotate in the arrow V direction actuated by the springs 65, 67 respectively until the crank 62 comes into an engagement with the stopper 66**.

The sensing member 70 is thus moved in the direction of the arrow U, via the U-shaped members 68, while being guided by the guide plate 73, as far as where the projection portion **70*b* comes to be positioned right under the front end portion 16*a* of the interposer 16. If and when a second key lever 11 is depressed, while the sensing member 70 remains in this condition, that is, while the drive plate 24 is in a rotational movement, the sensing member 70 is depressed downwards by shifting of an interposer 16 corresponding to the second key lever 11 from the non-operational position to the first operational position. The downward movement of the sensing member 70 will move the swing member 74, resisting the force of the tension spring 75, in the direction of the arrow W for releasing the engagement of the opening 79 of the locking member 77 with the hook portion 76. The locking member 77 is consequently moved in the direction of the arrow S in accordance with the force of the tension spring 82 to come into abutment on the flat portion 36*a* of the clutch regulating lever 36 which is already completed or about to complete the returning to the engageable position, due to the action of the return cam 43, with the clutch pawl portion 33*a*. When the locking member 77 has abutted on the clutch regulating lever 36 in the course of returning, the movement thereof follows the transition movement of the latter until the latter reaches the position engageable with the clutch pawl portion 33*a***.

The clutch regulating lever 36 which has been returned to the position engageable with the clutch pawl portion **33*a*, is to be retained there stably by the already returned retaining lever 38. Due to the depression of the second key lever 11, the retaining lever 38 is naturally released from the engagement with the clutch regulating lever 36, however, the engagement between the clutch member 33 and the clutch regulating lever 36 will be held as it is because the clutch regulating lever 36 is locked at the place by the end 81 of the locking member 77** as earlier stated.

As a result of it, depressing of the above-mentioned second key lever 11 will never cause type-printing operation of the print head 3, and furthermore type-printing due to any of the succeeding depression of the key levers 11 will be suspended.

Through such a mechanism, the printing error operation can be completely eliminated, which may happen in the course of too rapid typing operation by a typist such as (a) omitting of printing of a desired character caused by the idle returning of the corresponding interposer 16 to the non-operational position, attributable to a depression of another key lever 11 while the drive plate 24 is still in the rotating movement, which interposer should have been driven by the drive plate 24 at its second round rotating movement after having returned from the first round rotation to the upright position, or (b) printing of undesired character due to misselecting of a type, which may happen in some kind of the character-selecting mechanism. Moreover the typist can notice quite easily her too rapid typing operation being warned by a non-operating state of the typewriter caused thereby.

The description on how one is to operate for restoring the typewriter from the idling state to a normal operating state follows. When the above-mentioned condition has been achieved, the clutch mechanism 29 for printing is standstill at a state of having completed one round of operational cycle, and the drive plate 24, the pair of cranks 61, 62, the sensing member 70 and the rotating member 74 are all returned to the state shown in FIG. 2. All a typist has to do is, therefore, to depress the margin release key 83 downwards and then a rotation of the rotating lever 86 in the arrow T direction will cause the locking member 77 to move in the counter arrow S direction for coming into engagement with the hook portion 76 of the swing member 74 which is already returned to the normal condition. This state corresponds to that shown in FIG. 2, i.e., a posture ready to operate in a usual way. The typist can therefore continue the typing operation under normal conditions.

The detailed description above is of course for exemplifying the invention, not for limiting this invention to this embodiment only, so various possible modifications and variations which do not depart from the spirit of this invention should be interpreted to be included in the present invention.

What is claimed is:

1. In an electric typewriter having a keyboard with a plurality of keys, a continuous rotating motor and a printing mechanism including a character selecting mechanism, the improvement which comprises:

a plurality of interposers movably supported beneath said keyboard, each of said interposers being depressible by respective one of said keys of said keyboard;

a common drive member located adjacent to all of said interposers and actuating any depressed one of said interposers for operating said character selecting mechanism in said printing mechanism;

a clutch disposed between said motor and said drive member;

a regulating lever, disposed adjacent to said clutch, being movable between a first position for keeping said clutch in a disengaged condition and a second position for allowing said clutch to be engaged;

holding means disposed between said regulating lever and each of said interposers, said holding means normally holding said regulating lever in said first position and permitting movement of said regulating lever from said first position to said second position when any of said interposers is depressed;

a cam member rotated for returning said regulating lever to said first position upon engagement of said clutch;

a sensing member movably supported in parallel to and operatively connected with said drive member for being reciprocally moved in a first direction, said sensing member being further moved in a second direction by a second one of said interposers depressed subsequently while said sensing member is still in a course of the reciprocal movement caused by a previously depressed one of said interposers;

a lock member disposed engageably with said regulating lever in said first position for locking said clutch in the disengaged condition;

a latch member operatively engaged with said sensing member and said lock member respectively, said latch member being normally kept in a latching position to hold said lock member away from said regulating lever and being moved from the latching position by said sensing member when said sensing member is moved in the second direction;

a spring for pulling said lock member toward said regulating lever when said latch is moved from the latching position; and returning means connected with at least one special key of said keyboard for returning said lock member to the position normally held away from said regulating lever.

2. An improved typewriter according to claim 1, wherein said sensing member is formed into a comb-shaped plate provided with slots and teeth and is movably supported, in a horizontal direction as the first direction, under said interposers so that said each slot thereof normally corresponds to each of said interposers and so that each of said teeth thereof corresponds to each of said interposers in the course of the reciprocal movement thereof, and said sensing member is further moved in in a vertical direction as the second direction by said second interposer depressed subsequently while said teeth correspond to said interposers.

3. An improved electric typewriter claimed in claim 2, wherein said printing mechanism includes a single print-head.

4. An improved typewritter according to claim 1, wherein said printing mechanism is completely mechanically constructed and included a single print head.

5. An improved electric typewriter according to claim 1, wherein said printing mechanism includes a single print head.

* * * * *